United States Patent [19]

Sigmund

[11] Patent Number: 4,872,601

[45] Date of Patent: Oct. 10, 1989

[54] TWO LARGE ROLL TOILET TISSUE DISPENSER

[75] Inventor: Jerry A. Sigmund, Bala Cynwyd, Pa.

[73] Assignee: Scott Paper Company, Philadelphia, Pa.

[21] Appl. No.: 93,344

[22] Filed: Sep. 4, 1987

[51] Int. Cl.[4] ..... B65H 35/10

[52] U.S. Cl. ..... 225/38; 225/47; 225/54; 225/80; 242/55.3

[58] Field of Search ..... 225/34, 37, 38, 46, 225/47, 54, 77, 80; 242/55.2, 55.3, 55.53; 312/38-41

[56] References Cited

U.S. PATENT DOCUMENTS

| | | | |
|---|---|---|---|
| D. 275,246 | 8/1984 | Lander | D6/521 |
| 1,039,344 | 9/1912 | Wilkinson et al. . | |
| 1,912,363 | 6/1933 | DeWaide | 225/37 X |
| 2,107,603 | 2/1938 | Ellenburg | 242/55.3 |
| 2,839,346 | 6/1958 | Lawalin | 225/34 X |
| 3,294,329 | 12/1966 | Tucker et al. | 242/55.3 |
| 4,003,526 | 1/1977 | Fishburn | 242/55.3 |
| 4,354,643 | 10/1982 | Kenno | 242/55.2 |

*Primary Examiner*—Frank T. Yost
*Assistant Examiner*—Michael D. Folkerts
*Attorney, Agent, or Firm*—Joseph H. Yamaoka; John W. Kane, Jr.; N. J. DeBenedictis

[57] ABSTRACT

A wall mounted toilet tissue dispenser for two very large rolls of toilet tissue. The rolls are rotatably supported side by side in the dispenser with the axis of each roll perpendicular to the mounting wall of the dispenser. Paper is dispensed through a dispensing opening located at the bottom of the dispenser. Tail guide members are provided in the dispenser for limiting the location in the dispensing opening of the tail of each roll of tissue and for guaranteeing that the paper is at an angle to the vertical when the paper is severed so that after the paper is cut the tail will project below the dispensing opening when the paper falls to a vertical position.

11 Claims, 3 Drawing Sheets

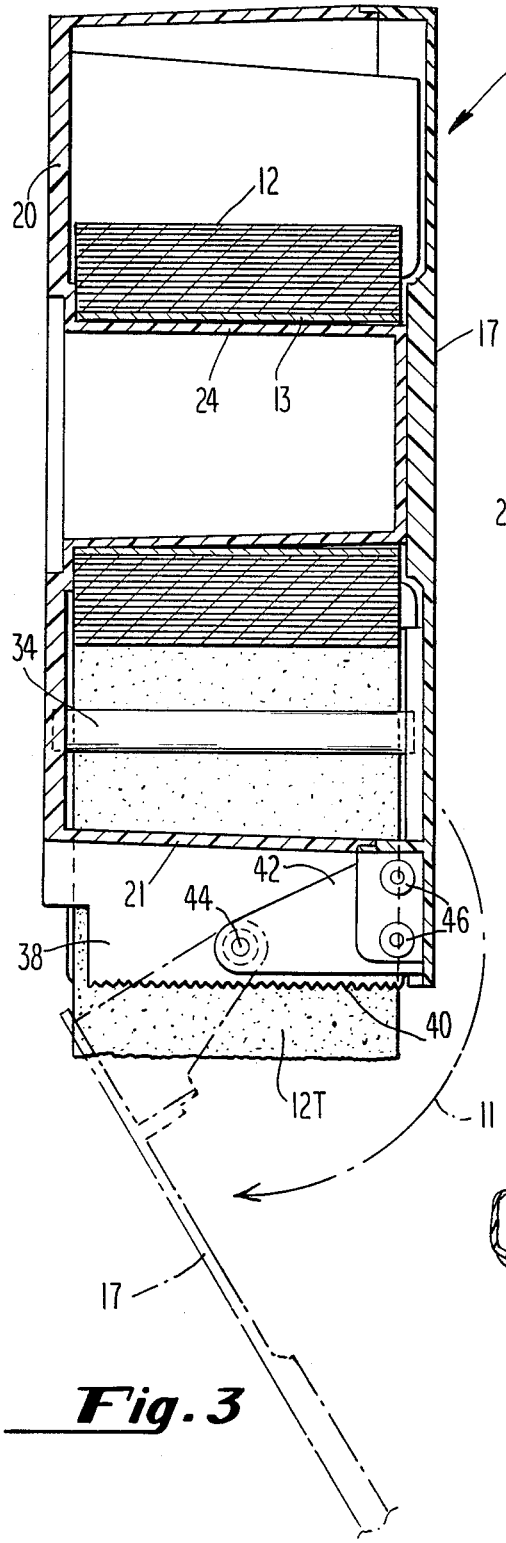
Fig. 3
Fig. 4
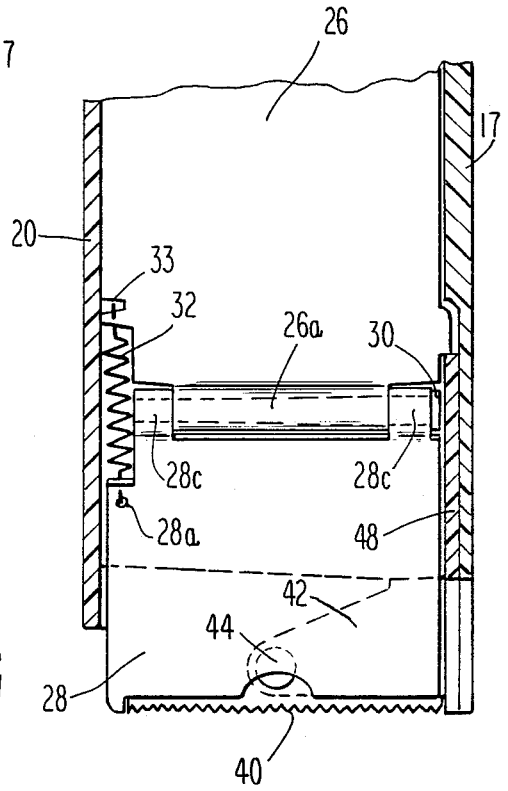
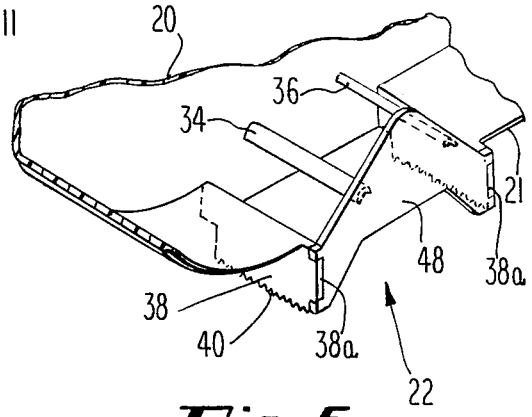
Fig. 5

TWO LARGE ROLL TOILET TISSUE DISPENSER

TECHNICAL FIELD

This invention relates generally to a two roll toilet tissue dispenser and more particularly to a wall mounted toilet tissue dispenser supporting two very large rolls of toilet tissue mounted side by side in the dispenser with the axis of each roll perpendicular to the wall of the dispenser that is to be attached to the wall of the washroom.

BACKGROUND ART

Until very recently, toilet tissue rolls that have been available for use in commercial and industrial washrooms have a diameter between four and five inches. Many wall mounted dispensers have been developed to hold two or more of these standard rolls of tissue. Two roll toilet tissue dispensers have been designed to dispense two or more standard rolls of toilet tissue with the axis of each roll either parallel to or perpendicular to the wall of the dispenser that is mounted onto a wall of the washroom. Dispensers have also been designed to mount standard rolls of toilet tissue either one above the other or in a side by side relationship. A typical example of a dispenser wherein the rolls are mounted side by side with the axis of each roll perpendicular to the wall of the dispenser that is affixed to a wall of the washroom is shown in U.S. Pat. No. 3,294,329.

More recently there has been developed a very large roll of toilet tissue particularly suitable for high usage public washrooms such as in a sports stadium. These very large rolls have a diameter of between about 0.2 meters (8 inches) to about 0.33 meters (13 inches) and typically hold anywhere from about five to about twelve times the amount of tissue as the prior standard diameter toilet tissue rolls. Heretofore, these very large toilet tissue rolls have been dispensed from single roll dispensers and because of the very large diameter, the roll has been mounted in the dispenser so that the axis of the roll is perpendicular to the wall of the dispenser that is affixed to the washroom wall. One example of a dispenser for a very large roll of toilet tissue is shown in U.S. Design Patent No. 275,246.

One problem with the single large roll toilet tissue dispenser is that if the person maintaining the dispenser opens the dispenser and sees that 80% of the roll has been used, the maintenance person must decide whether to leave that roll in the dispenser and take the chance that the roll will not run out before he comes to service the dispenser again or to remove the roll and replace it with a full roll. Rather than take the chance of displeasing the patrons of the washroom, the maintenance person will often place a new roll in the dispenser and throw away the partially used roll which may contain as much paper as one or two standard diameter tissue rolls. Thus, there is a need for a two large roll toilet tissue dispenser which includes means for limiting access to the second roll while paper is being dispensed from the first roll.

As in many wall mounted toilet tissue roll dispensers, it is desirable to dispense from the bottom of the dispenser. It is also believed desirable to close off as much of the bottom of the dispenser as possible by providing bottom walls adjacent to each sidewall of the dispenser. This presents the problem that, on occasion, the entire free end, or tail, of the roll can end up on the bottom wall so that the tail does not project through the dispensing opening. The user must then grope for the tail in the dispenser which is undesirable. What would be desirable is to have some means in the dispenser which helps prevent the tail of the roll from being displaced from the dispensing opening onto any flat surface at the bottom of the dispenser.

When the paper on these very large diameter rolls of toilet tissue is not perforated to form individual sheets, it is necessary to provide at the dispensing opening a tensioning edge for severing paper from the roll. This tension edge is usually parallel to the axis of the roll. A problem with locating the tensioning edge at the bottom of the dispenser is that depending on how the roll is located with respect to the tensioning edge and the amount of paper left on the roll, when the user severs the paper from the roll, the tail can remain located adjacent to the tensioning edge at the dispensing opening where it does not extend below the dispensing opening and thus is not visible to the user. This also encourages the user to grope within the dispensing opening or into the dispenser in order to locate the tail, which is undesirable. It would also be desirable to provide means in the dispenser for assuring that a portion of the tail of the roll extends below the dispensing opening so it is readily visible to the user no matter how the roll is horizontally positioned with respect to the dispensing opening of the dispenser or how much of the roll has been used. It is also believed to be desirable to maintain the angle that the paper makes within the dispensing opening with the cutting edge independent of the diameter of the roll in an attempt to maintain uniform cutting conditions when the web is severed. U.S. Pat. No. 1,039,344 discloses means in a wrapping paper cabinet for maintaining paper at a constant angle with respect to the cutting edge for the paper.

It is therefore one object of this invention to provide an improved dispenser for dispensing two rolls of toilet tissue that have a very large diameter.

Another object of this invention is to provide a two large roll toilet tissue dispenser which includes means for restricting access to the second roll until the first roll has been completely exhausted.

Another object of this invention is to provide a dispenser for two very large rolls of toilet tissue mounted side by side wherein the dispensing takes place at the bottom of the dispenser and wherein means are provided for preventing the tail of the roll being dispensed from being displaced onto the bottom wall of the dispenser.

And yet another object of this invention is to provide a dispenser for two large rolls of toilet tissue which has a dispensing opening at the bottom and wherein the tail of the roll being dispensed always extends below the dispensing opening so that it is readily visible by the user.

A further object of this invention is to provide a dispenser for two large rolls of toilet tissue wherein the paper is severed at a tensioning edge located at the bottom of the dispensing opening and wherein the paper inside the dispensing opening makes a constant angle with the tensioning edge as the diameter of the roll decreases.

DISCLOSURE OF THE INVENTION

In accordance with this invention, there is provided a wall mounted toilet tissue dispenser for two very large rolls of toilet tissue. The rolls are rotatably supported side by side in the dispenser with the axis of each roll perpendicular to the mounting wall of the dispenser. Paper is dispensed through a dispensing opening located at the bottom of the dispenser by pulling on the free end, or tail, of the roll causing the roll to rotate and paper to unwind and then severing the paper from the roll by tensioning the paper against a tensioning edge at the dispensing opening.

In one aspect of the invention tail guide members are provided in the dispenser, the tail guide members having a surface for fixing the location in the dispensing opening of the tail of each roll of tissue when the radius of the roll is less than the perpendicular distance from the vertical plane passing through the centerline of the roll to its tail fixing surface.

When the paper is severed by tensioning the paper against the tensioning edge of the dispenser, the tail guide member guarantees that the paper is at an angle to the vertical so that when the paper is severed the tail will project below the tensioning edge when the paper falls to a vertical position.

In another aspect of this invention, the dispenser includes a baffle pivotally mounted in the cabinet having a first position which blocks access to one roll and having a second position which blocks access to the other roll, and means in the cabinet for biasing the baffle at the first or second position.

DESCRIPTION OF THE DRAWINGS

While the specification concludes with claims particularly pointing out and distinctly claiming that which is regarded as the present invention, the objects and advantages of this invention can be more readily ascertained from the following description of a preferred embodiment when read in conjunction with the accompanying drawings in which:

FIG. 3 is a sectional view taken along the line 3—3, in the direction of the arrows, as indicated in FIGS. 1 and 2;

FIG. 4 is a partial sectional view taken along the line 4—4, in the direction of the arrows, as indicated in FIG. 2;

FIG. 5 is a fragmentary, perspective view showing the construction of the dispensing opening.

BEST MODE FOR CARRYING OUT THE INVENTION

Figure 1:
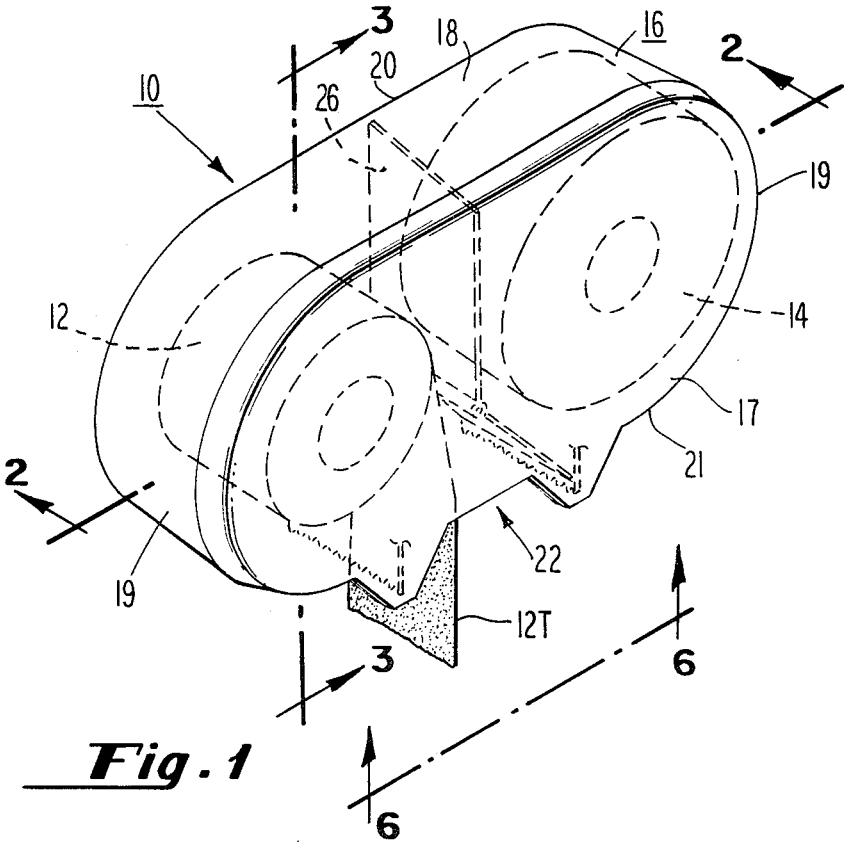
FIG. 1 is a perspective view of the two roll toilet tissue dispenser of this invention.

For the sake of convenience, an element depicted in more than one FIGURE will retain the same element member in each FIGURE. Referring now to FIG. 1 there is shown the two roll toilet tissue dispenser 10 of this invention. The dispenser 10 has a container section 16 and a cover section 17. The toilet tissue dispenser 10 holds two very large rolls 12, 14 of toilet tissue. In one preferred embodiment, the diameter of each roll 12, 14 is 0.23 meters (9.0 inches) which is equivalent to about six rolls of the prior art standard toilet tissue rolls. As shown in FIG. 1, roll 14 is a spare roll and roll 12 which is currently in use has its end, or tail portion, 12T extending through a dispensing opening 22 at the bottom of dispenser 10. The rolls 12, 14 are supported in the cabinet in a side by side relationship with the axis of each roll perpendicular to the rear of mounting wall 20 of the dispenser 10.

Figure 2:
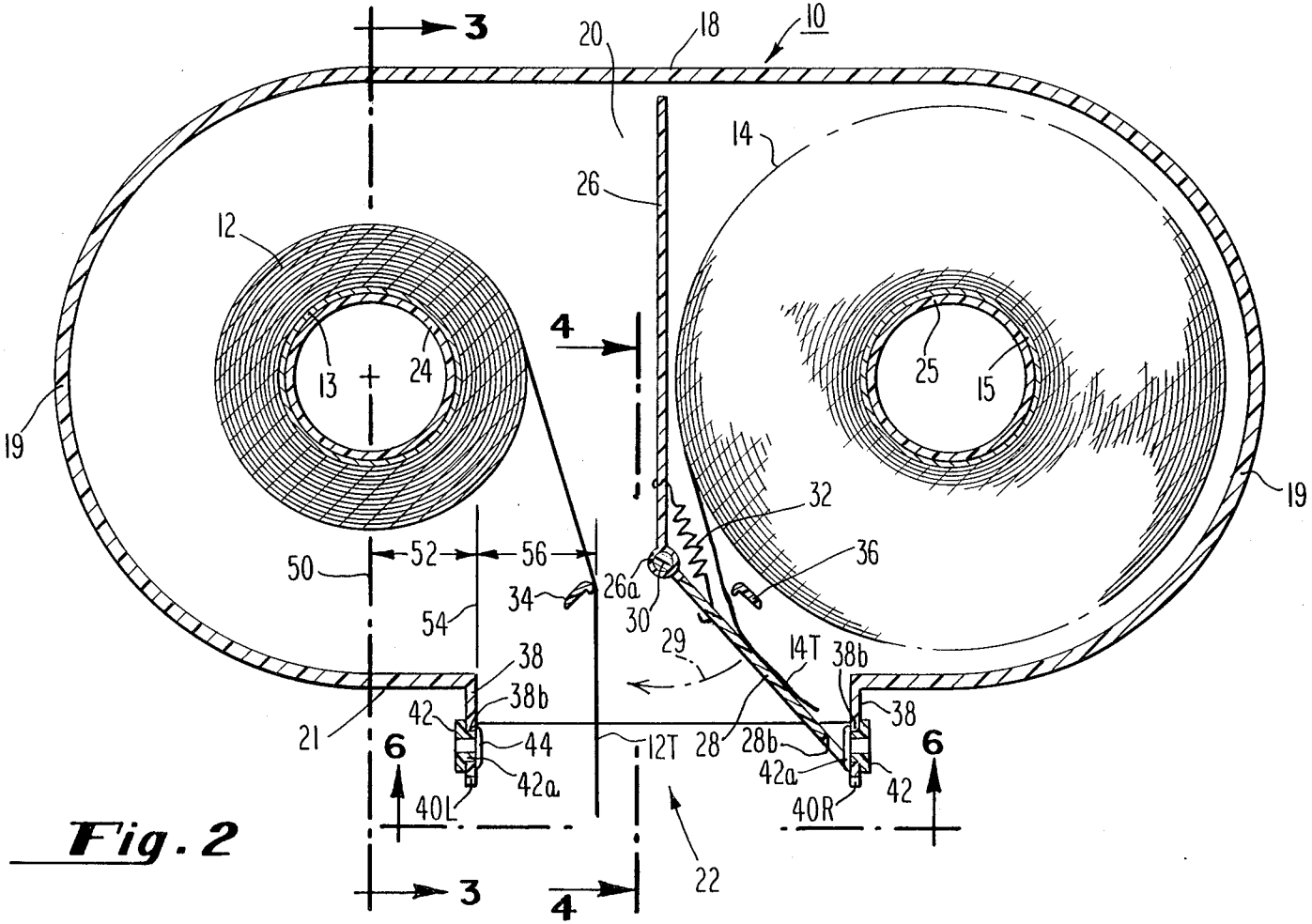
FIG. 2 is a sectional view taken along the line 2—2, in the direction of the arrows, as indicated in FIG. 1.

As best shown in FIG. 3, the cover 17 of dispenser 10 opens by pivoting downward as indicated by arrow 11 and the dashed outline of the cover 17. The cover 17 is pivotally attached to the container unit 16 by means of a pair of pivot links 42 which are attached to the cover 17 by means of screws 46. Each pivot link 42 has an annular extension **42*a*, as shown in FIG. 2, that extends into a hole 38*b* centrally located at the bottom of dispensing throat vertical wall 38. Pin 44 which has a head that is larger than the diameter of the hole 38*b* is pressed into the opening of annular extension 42*a* which prevents the cover 17 from being separated from the container portion 16 of dispenser 10**.

The container section 16 has a top wall 18, rounded sidewalls 19, partial bottom walls 21 and a rear wall 20. The rear wall 20 has a number of mounting holes (not shown) so that the dispenser 10 can be affixed by means, such as screws, to a wall of a washroom.

Referring now to FIG. 2, it can be seen that roll 12 is wound on a paperboard core 13 and roll 14 is wound on a paper core 15. Cylindrical members 24 and 25 extending from rear wall 20 of dispenser 10 provide the means for supporting the two rolls 12, 14 in the dispenser 10. The cylindrical support members 24, 25 have a smaller diameter than the inside diameter of cores 13, 15 thereby allowing the rolls 12, 14 to rotate in response to a user pulling on the tail portion 12T, 14T of the rolls 12, 14. The central portion of bottom wall 21 has been removed to provide a dispensing opening 22 at the bottom of the dispenser 10. Vertical walls 38 extend down from bottom walls 21 to partially define the boundary of the dispensing opening 22. The lower edge 40 of each vertical wall 38 is used as a tensioning edge so that the user can sever paper from the roll and, in a preferred embodiment, tensioning edge 40 is serrated to further assist the severing of paper from the rolls 12, 14.

Figure 6:
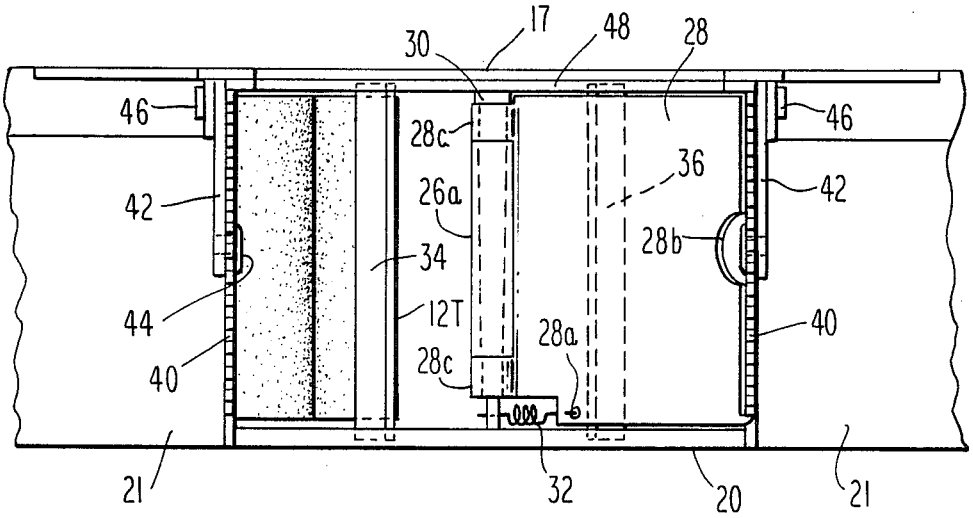
FIG. 6 is a partial bottom view looking along the line 6—6 of FIGS. 1 and 2.

The dispenser 10 is partially divided into two compartments by means of a vertical wall 26. The compartmentalization of the dispenser 10 is completed by means of a pivoted baffle 28. As shown in FIG. 2, baffle 28 is pivoted to the right to prevent access to the spare roll 14 when paper is being dispensed from roll 12. Tail 14T of the spare roll 14 is shown resting on the upper surface of baffle 28. Baffle 28 is retained in the position shown in FIG. 2 by means of a biasing spring 32. As shown in FIGS. 2 and 6, notch **28*b* at the bottom of baffle 28 provides the user with a means for moving the baffle, as indicated in FIG. 2 by arrow 29, so that it provides access to the backup roll 14 stored in the right-hand compartment of the dispenser 10. The detailed assembly of hinged baffle 28 is best shown in FIGS. 4 and 6. In those FIGURES it can be seen that the lower edge of vertical divider wall 26 terminates in a hollow cylinder 26*a*. The extreme ends of the upper edge of baffle 28 each terminate in cylinders 28*c*. A hinge pin 30 which passes through the two cylindrical members 28*c* of the baffle 28 and the cylindrical member 26*a* formed at the edge of vertical wall 26 provides for the pivotal movement of baffle 28. Spring 32 functions to bias the baffle 28 in the position that prevents access to either the left or right compartment of the container section 16 of dispenser 10. One end of spring 32 is captured by a spring retainer 33 extending from rear wall 20 of dispenser 10 while the other end of spring 32 is captured by hole 28*a* in baffle 28**.

Referring back to FIG. 2, there is shown a tail guide rod 34 associated with roll 12 and a tail guide rod 36 associated with roll 14. As best shown in FIGS. 5 and 6 the rear ends of tail guide rods 34, 36 are supported by rear wall 20 of dispenser 10 and the front ends of tail guide rods 34, 36 are supported by a reinforcing plate 48. As best shown in FIG. 5, reinforcing plate 48 interlocks with tabs 38*a* formed in vertical dispensing throat walls 38 to provide additional rigidity to the container section 16 of dispenser 10.

The utility of tail guide rods 34, 36 can best be appreciated by considering how the dispenser 10 would function if these tail guide rods 34, 36 were not a part of the dispenser 10. Referring now to FIG. 2, assume that the dispenser 10 is mounted on the left sidewall of a toilet stall, and that to dispense paper, the user pulls on tail 12T and severs paper from roll 12 by tensioning it against serrated edge 40L. When the radius of roll 12 is equal to or less than the distance 52 between a plane passing through the vertical center line 50 of roll support 24 and a vertical plane, represented by line 54 in FIG. 2, obtained by extending the inside surface of throat wall 38, when the paper is severed from the roll 12, tail 12T will be adjacent to the inside surface of throat wall 38 with very little or no tail 12T extending below serrated edge 40L. If the tail 12T is not visible to the user, the user may grope for the tail within the dispenser 10 or thinking that the roll 12 is exhausted may move the baffle door 28 to begin dispensing from the spare roll 14. Another problem that can arise if the tail 12T hangs adjacent to throat wall 38 is that tail 12T may get placed, for example by a draft, onto the bottom wall 21 inside the dispenser 10. Again, the user may grope within the dispenser 10 to look for the tail 12T or may prematurely begin dispensing from the spare roll 14. The use of tail guide rods 34, 36 can solve both of the above problems. By locating tail guide rod 34 toward the center of the dispensing opening 22, and by placing the tail 12 so that it extends between tail guide rod 34 and the baffle pivot 30 before passing through the dispensing opening 22, when the radius of roll 12 is equal to or less than the distance represented by the sum of lines 52 and 56 of FIG. 2, the tail 12T will contact a surface of tail guide rod 34. Thus, tail guide rod 34 maintains the tail 12T spaced away from the ledge formed by the bottom 21 of dispenser 10 which makes it less likely that the tail 12T can somehow get placed on bottom wall 21 of dispenser 10. Furthermore, even if the tail 12T does tend to get placed on bottom wall 21, gravity will tend to act on the tail 12T so that it will fall back to the position shown in FIG. 2. The location of tail guide rods 34, 36 toward the center of the dispensing opening 22 also guarantees that the tail 12T always makes an angle to the vertical dispensing throat wall 38 when it is cut by serrated edge 40L, so that after the web is severed, the tail 12T falls back to a vertical position. A significant portion of tail 12T, typically 0.02 meters (0.75 inches), extends below edge 40 of the dispensing opening 22 with the result that the tail 12T is readily visible to the user regardless of the diameter of roll 12.

Referring again to FIG. 2, if it is assumed that the dispenser 10 is mounted on the sidewall of a stall that is to the right of the user so that the user is dispensing from roll 12 and severing the paper by using serrated edge 40R, it is preferred to locate the hinge point for baffle 28 at a position such that the paper from roll 12 always contacts the outer surfaces of cylinder 26*a* and 28*c* when the paper is tensioned against serrated edge 40R. This helps provide uniform web cutting conditions by maintaining the paper inside the dispensing throat at a constant angle regardless of the diameter of roll 12.

While the present invention has been described with reference to a specific embodiment thereof, it will be obvious to those skilled in the art that various changes and modifications may be made without departing from the invention in its broader forms. For example, although the walls 38 that partially define the dispensing opening 22 have been shown as vertical, it is clear that they could be formed at an angle to the vertical. Also, since the dispenser 10 is mounted on a wall, it may be possible to eliminate the rear wall of the dispenser 10.

What is claimed as new and desired to be secured by Letter Patent of the United States is:

1. A two roll toilet tissue dispenser comprising:

(a) means in the dispenser for rotatably supporting the two rolls with the axis of each roll perpendicular to a mounting wall of the dispenser;

(b) a dispensing opening centrally located at the bottom of the dispenser and at least in part formed by two walls extending down from the bottom of the dispenser, each wall being located nearer to the center axis of one roll and its respective tail fixing surface than the other downwardly extending wall, and, the wall terminating in a tensioning edge parallel to the axes of the rolls, and (c) means mounted in the dispenser having a surface for fixing the location in the dispensing opening of the tail of at least one of said roll of tissue when the radius of the roll is less than the perpendicular distance from the vertical plane passing through the centerline of said roll to its respective tail fixing surface and wherein the perpendicular distance from the vertical plane passing through the centerline of a roll to the nearest tensioning edge is less than the perpendicular distance from said plane to the nearest roll tail fixing surface.

2. A dispenser as recited in claim 1 wherein the two walls extending down from the bottom of the dispenser are vertical.

3. A dispenser as recited in claim 1 further comprising:

(a) a baffle pivotally mounted in the dispenser having a first position which blocks access to one roll and having a second position which blocks access to the other roll; and (b) means in the dispenser for biasing the baffle at the first or second position.

4. A dispenser as recited in claim 1 further comprising a tissue contacting surface located in the dispenser between one roll and the tensioning edge of the dispensing opening downwardly extending wall farthest from said one roll and located so that as said one roll is dispensed, the sheet is tensioned between said tissue contacting surface and the tensioning edge of said farthest downwardly extending wall.

5. A dispenser as recited in claim 4 and further comprising:

(a) a baffle pivotally mounted in the dispenser having a first position which blocks access to one roll and having a second position which blocks access to the other roll; and (b) means in the dispenser for biasing the baffle at the first or second position and, wherein the tissue contacting surface is provided at the baffle pivot.

6. A dispenser as recited in claim 1 wherein the roll tail fixing means for each roll is a bar mounted in the dispenser.

7. A dispenser as recited in claim 6 further comprising:

(a) a baffle pivotally mounted in the dispenser having a first position which blocks access to one roll and having a second position which blocks access to the other roll; and (b) means in the dispenser for biasing the baffle at the first or second position.

8. A dispenser as recited in claim 7 further comprising a tissue contacting surface located in the dispenser between one roll and the tensioning edge of the dispensing opening downwardly extending wall farthest from said one roll and located so that as said one roll is dispensed, the sheet is tensioned between said tissue contacting surface and the tensioning edge of said farthest downwardly extending wall.

9. A dispenser as recited in claim 8 wherein the tissue contacting surface is provided at the baffle pivot.

10. A wall-mounted toilet tissue dispenser having a rear mounting wall and front, top, bottom and sidewalls comprising:

(a) means in the dispenser for rotatably supporting two rolls side by side with the axis of each roll perpendicular to the rear wall of the dispenser;

(b) a dispensing opening centrally located at the bottom of the dispenser through which paper from each roll can be withdrawn:

(c) a baffle pivotally mounted at the bottom of the dispenser, the baffle having a first position that, in conjunction with the front, bottom and sidewalls,, blocks access through the dispensing opening to one roll and allow access to the other roll, and having a second position that blocks access through the dispensing opening to the other roll and allows access to the one roll; and (d) means in the dispenser for biasing the baffle at the first or second position.

11. A dispenser as recited in claim 10 wherein the dispensing opening is in part formed by two downwardly extending walls, each wall terminating in an edge for severing the paper when the paper is tensioned there against.

* * * * *